United States Patent [19]

Honma et al.

[11] Patent Number: 4,889,083

[45] Date of Patent: Dec. 26, 1989

[54] INTAKE SYSTEM FOR V-TYPE MULTI-CYLINDER INTERNAL COMBUSTION ENGINE

[75] Inventors: Masayuki Honma, Yokohama; Akihiko Masatate, Fujisawa, both of Japan

[73] Assignee: Nissan Motor Co., Ltd., Yokohama, Japan

[21] Appl. No.: 308,553

[22] Filed: Feb. 10, 1989

[30] Foreign Application Priority Data

Feb. 15, 1988 [JP] Japan ..... 63-30886
Mar. 24, 1988 [JP] Japan ..... 63-38793[U]

[51] Int. Cl.[4] ..... F02B 75/22
[52] U.S. Cl. ..... 123/52 MV
[58] Field of Search ..... 123/52 M, 52 MB, 52 MV, 123/52 MC, 52 ML

[56] References Cited

U.S. PATENT DOCUMENTS

| | | | |
|---|---|---|---|
| 1,761,958 | 6/1930 | Anderson | 123/52 MV |
| 1,897,783 | 2/1933 | Anibal | 123/52 MV |
| 2,771,863 | 11/1956 | Porsche et al. | 123/52 MV |
| 3,520,284 | 7/1970 | Ruoff et al. | 123/52 MV |
| 4,364,340 | 12/1982 | Kimura | 123/52 MV |

FOREIGN PATENT DOCUMENTS

| | | | |
|---|---|---|---|
| 2750586 | 7/1978 | Fed. Rep. of Germany | 123/52 MV |

*Primary Examiner*—David A. Okonsky
*Attorney, Agent, or Firm*—Foley & Lardner, Schwartz, Jeffery, Schwaab, Mack, Blumenthal & Evans

[57] ABSTRACT

An intake system for a V-type multi-cylinder internal combustion engine includes an elongated collector housing disposed between two rows of cylinders in such a way as to longitudinally extend across the rows of cylinders at substantially the center thereof and at right angles. The collector housing have at the opposite ends spaced along the rows of the cylinders a plurality of openings in two rows. Two groups of intake pipes for the above described two rows of the cylinders are respectively connected to the opposite lateral ends of the collector housing in such a way as to communicate the openings. The intake pipes extend curvedly toward the rows of the cylinders and away from the collector housing and further extend curvedly toward the intake ports and in such a way as to have adjacent the intake ports, circumferential walls which extend across the axes of the intake ports and thereafter extend nearly coaxially with the intake ports.

11 Claims, 13 Drawing Sheets

INTAKE SYSTEM FOR V-TYPE MULTI-CYLINDER INTERNAL COMBUSTION ENGINE

BACKGROUND OF THE INVENTION

I. Field of the Invention

The present invention relates to an intake system for a V-type multi-cylinder internal combustion engine and more specifically to arrangement of some constituent parts of an intake system in the space between the rows of cylinders of a V-type multicylinder internal combustion engine.

II. Description of the Prior Art

An example of a prior art intake system for a V-8 internal combustion engine is shown in FIGS. 10 to 12.

Referring to the figures, intake air having passed an air cleaner (not shown) is conducted through an air duct 11 to a throttle chamber 10, then controlled in flow rate by a throttle valve 10*a* disposed in the throttle chamber 10 and flows into a surge tank or collector housing 1. The intake air having reached the collector housing 1 is drawn through independent intake passages or pipes 2–9 of substantially the same length and through respective intake ports 13 formed in a cylinder head 12 to respective cylinders 16. The reason why the intake pipes 2–9 are constructed so as to be of substantially the same length is for avoiding variations of the charging efficiency from cylinder to cylinder.

Fuel injectors 20 are installed on the curved portions of the intake pipes 2–9 adjacent the intake ports 13 and inject fuel toward intake valves 14. The injected fuel is mixed with intake air conducted thereto from the collector housing 1 through the intake pipes 2–9. The intake air/fuel mixture is supplied into the cylinders 16 and ignited at predetermined timings to burn, whereby to cause pistons 17 to reciprocate. After combustion of the mixture, the exhaust gases are discharged through exhaust ports 18 and exhaust valves 19 and through, though not shown, an exhaust purifying device and silencer to the open air.

In the meantime, 46 in FIGS. 10 and 12 is an alternator disposed at an end of the rows of cylinders of a V-8 internal combustion engine, and indicated by l in FIG. 10 is the distance between the collector housing 1 side end of the alternator 46 and the center of the cylinder 16 nearest the alternator 46.

By disposing some constituent parts of the intake system between the rows of cylinders of a V-type multi-cylinder internal combustion engine in the above described manner, it becomes possible to make the most of the characteristic features of the V-type multi-cylinder internal combustion engine, i.e., it becomes possible to make the engine of itself more compact and the overall height and length of the engine smaller as compared with a comparable in-line multi-cylinder internal combustion engine. For this reason, it is a usual practice to utilize the space between the rows of cylinders for arrangement of some constituent parts of the intake system.

FIG. 13 shows another prior art arrangement in which an elongated collector housing 1 is disposed so as to longitudinally extend across the rows of cylinders at substantially the center thereof and at right angles and provided with a plurality of openings the number of which are half the number of the cylinders and in which throttle valves 10*a* are disposed. The intake pipes are bifurcated at the portions downstream of the throttle valves 10*a* into pipe portions 2–9 which are communicated with the respective cylinders as disclosed in Japanese provisional patent publication No. 61-265347.

In the arrangements described above, the intake pipes are needed long in order to attain an efficient inertia charge at low speed. When, however, the collector housing 1 is disposed in the space between the rows of cylinders as shown in FIGS. 10 to 12, the collector housing 1 occupies most of the space between the rows of cylinders, thus making it impossible to arrange other engine accessories as an alternator, etc. between the rows of cylinders. Further, in order to make longer the intake pipes within a limited space surrounded by the cylinders in rows and the surge tank, it is necessary to provide a number of curved portions to the intake pipes, resulting in an increased flow resistance.

Further, in order to increase the lengths of the intake pipes without causing substantial increase of the overall all height of the engine and the flow resistance, it will be considered to make the collector housing 1 thinner for thereby increasing the distance between the collector housing 1 and the intake ports 13. However, this naturally results in an insufficient volume of the collector housing 1.

In this connection, as shown in FIG. 13, by disposing the collector housing 1 so as to longitudinally extend across the rows of cylinders at substantially the center thereof and at right angles, the space between the rows of cylinders is not largely occupied by the collector housing 1 and therefore it can be attained relatively with ease to increase the lengths of the intake pipes. However, since the intake pipes 2–9 are arranged so as to extend from the bottom of the collector housing 1 separately, the collector housing 1 is positioned relatively high above the cylinder head, thus increasing the overall height of the engine and therefore making it impossible to make the most of the characteristic features of the V-type multi-cylinder internal combustion engine.

SUMMARY OF THE INVENTION

In accordance with the present invention, there is provided an improved intake system for a V-type multi-cylinder internal combustion engine. The intake system comprises an elongated collector housing disposed between two rows of cylinders in such a way as to longitudinally extend across the rows at substantially the center thereof, and a plurality of intake pipes of substantially the same length, extending independently from the collector housing and communicating intake ports for the cylinders, respectively.

The collector housing has at the opposite ends spaced along the rows of the cylinders, a plurality of openings in two rows extending in the direction transversal to the rows of the cylinders. The intake pipes are connected to the collector housing in such a way as to communicate the openings, respectively. The intake pipes extend curvedly away from the openings and in such a way as to go toward the rows of the cylinders and away from the collector housing. The intake pipes further extend curvedly toward the intake ports and in such a way as to have adjacent the intake ports, circumferential walls which extend across the axes of the intake ports and thereafter extend nearly coaxially with the intake ports.

The above arrangement is effective for solving the above noted problems inherent in the prior art arrangement.

It is accordingly an object of the present invention to provide an improved intake system for a V-type multicylinder internal combustion engine which can efficiently utilize the space between the rows of cylinders for disposition of some constituent parts thereof.

It is another object of the present invention to provide an intake system of the above described character which can reduce the overall height and length of the engine, i.e., can make the engine compact without sacrificing the inertia charge and without increasing the flow resistance.

It is a further object of the present invention to provide an intake system of the above described character which is effective for reducing the number of constitutent parts and the manufacturing and assembling expense.

It is a further object of the present invention to provide an intake system of the above described character which can prevent variations of charging efficiency from cylinder to cylinder.

It is a further object of the present invention to provide an intake system of the above described character, some constituent parts of which can be handled as units and therefore is convenient in assembly and disasssembly.

It is a further object of the present invention to provide an intake system of the above described character which can improve the responsiveness of the engine.

DESCRIPTION OF THE PREFERRED EMBODIMENTS

Figure 1:
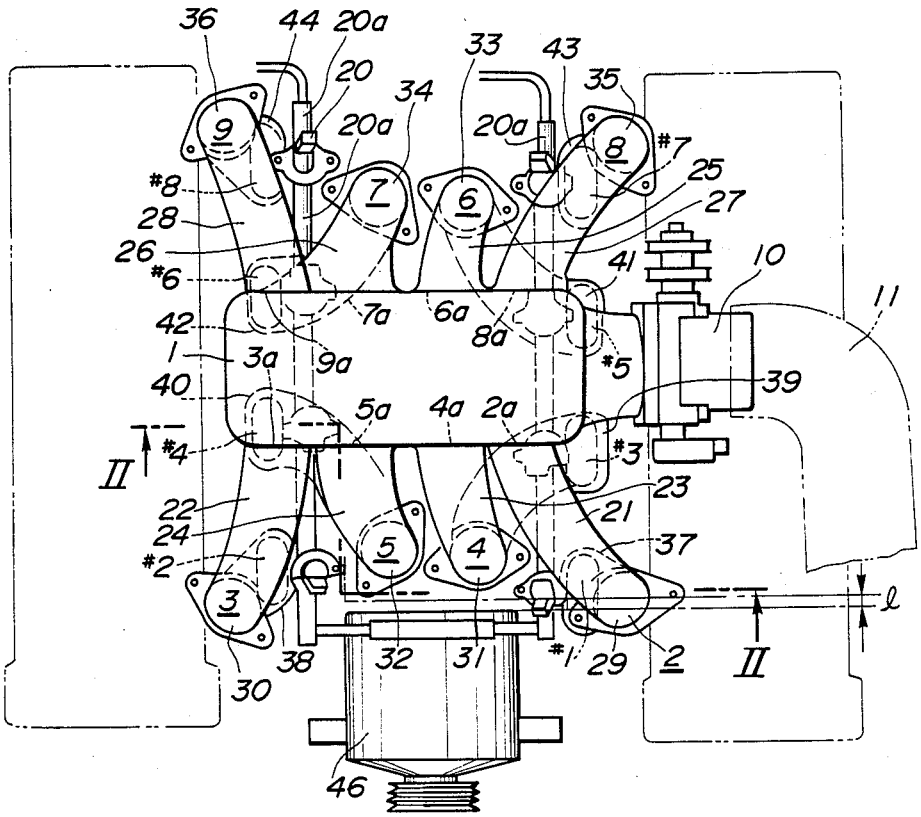
FIG. 1 is a top plan view of a V-type multicylinder internal combustion engine according to an embodiment of the present invention.
Figure 2:
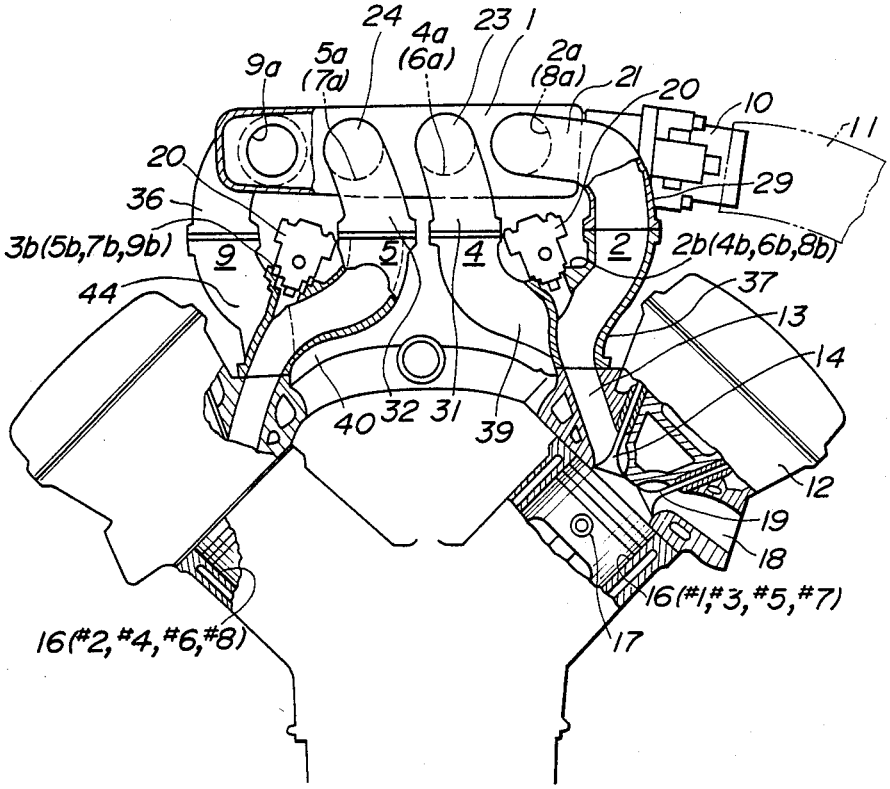
FIG. 2 is a sectional view taken along the line II—II of FIG. 1.
Figure 3:
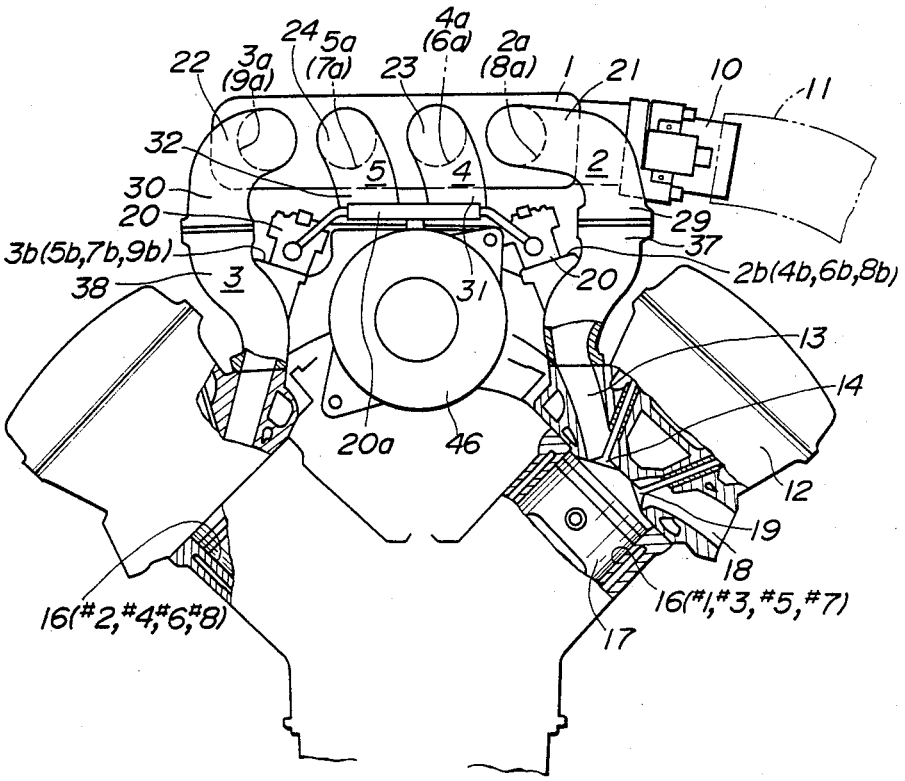
FIG. 3 is an elevational, partly sectioned, view of the engine of FIG. 1.
Figure 4:
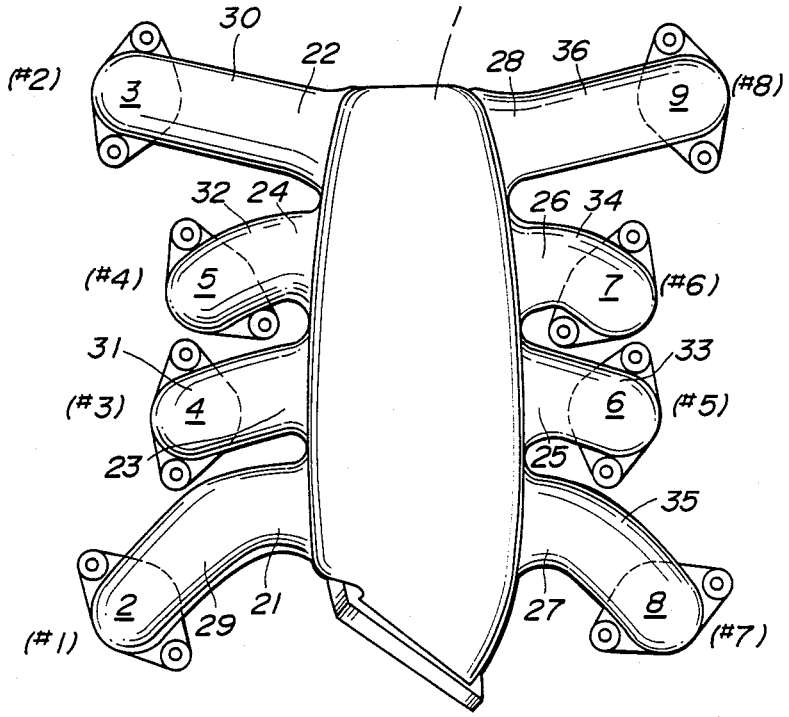
FIG. 4 is a top plan view of a collector housing and portions of intake pipes employed in an intake system according to another embodiment of the present invention.
Figure 10:
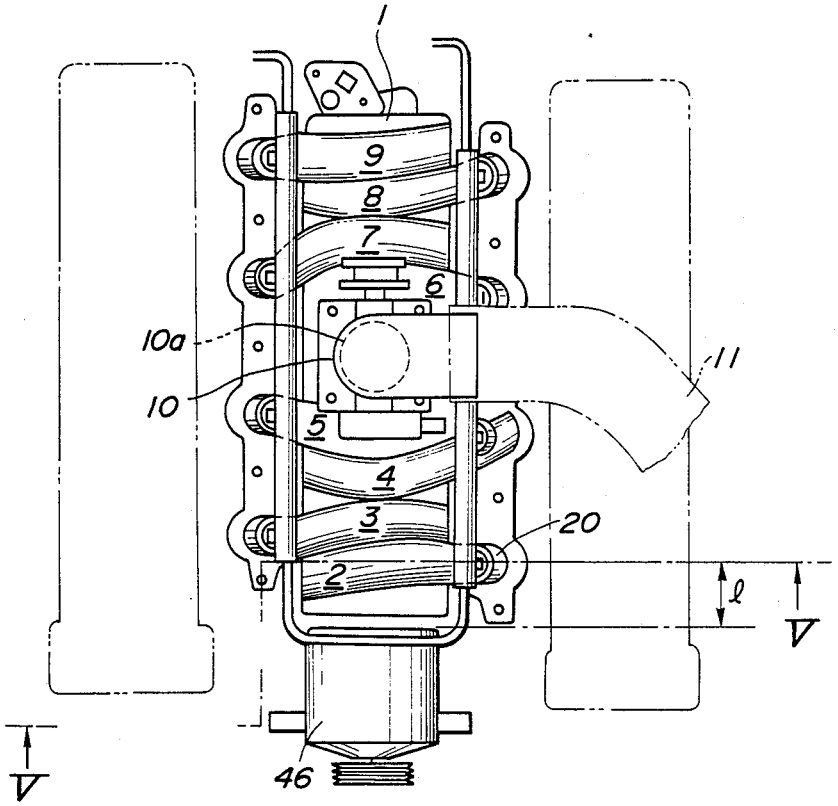
FIG.10 (PRIOR ART)
FIG. 10 is a top plan view of a prior art V-type multicylinder internal combustion engine.
Figure 11:
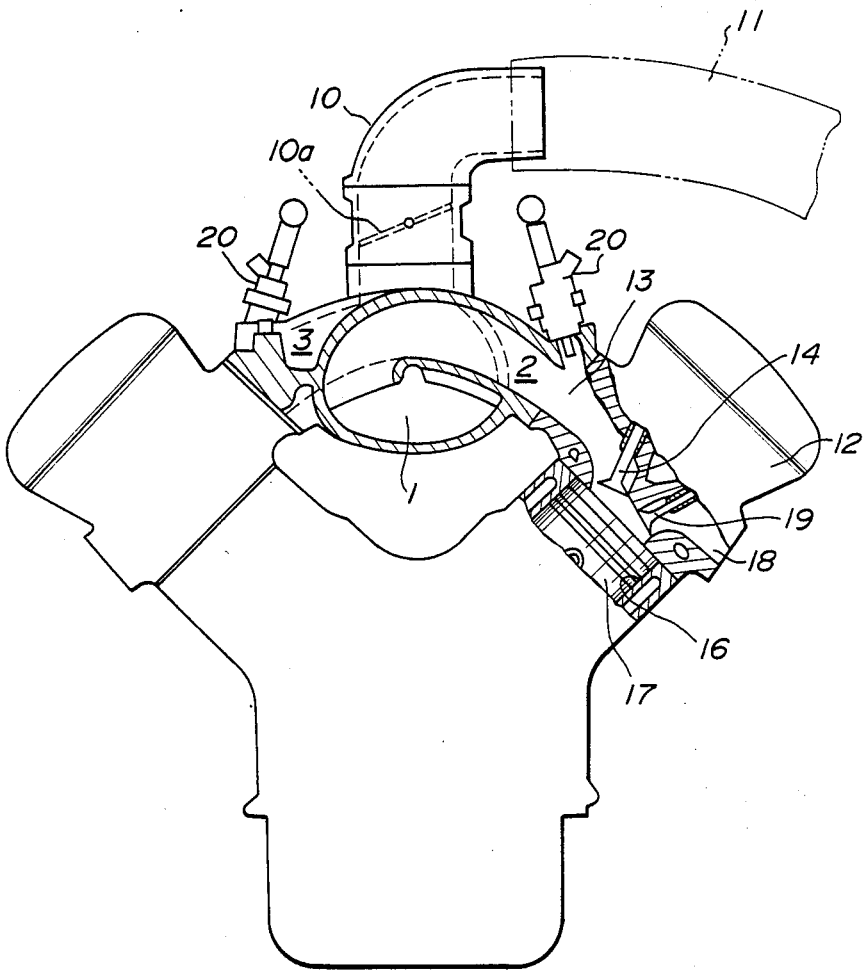
FIG.11 (PRIOR ART)
FIG. 11 is a sectional view taken along the line V—V of FIG. 10.
Figure 12:
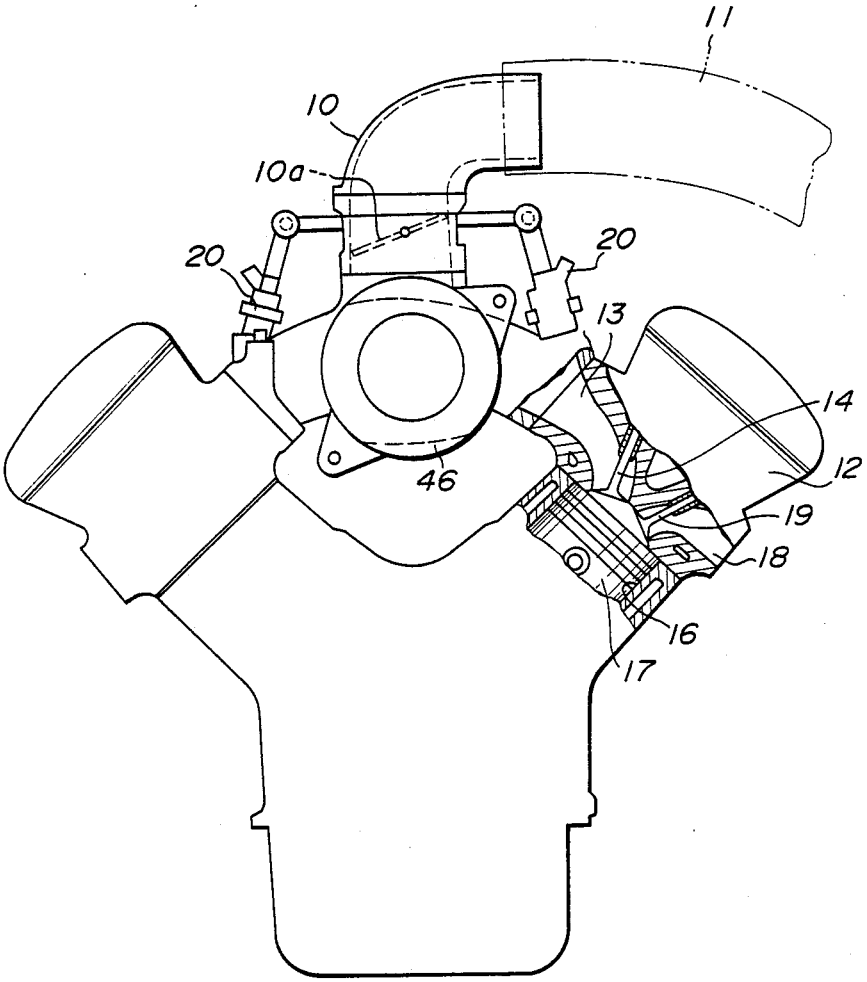
FIG.12 (PRIOR ART)
FIG. 12 is an elevational view of the engine of FIG. 10.
Figure 13:
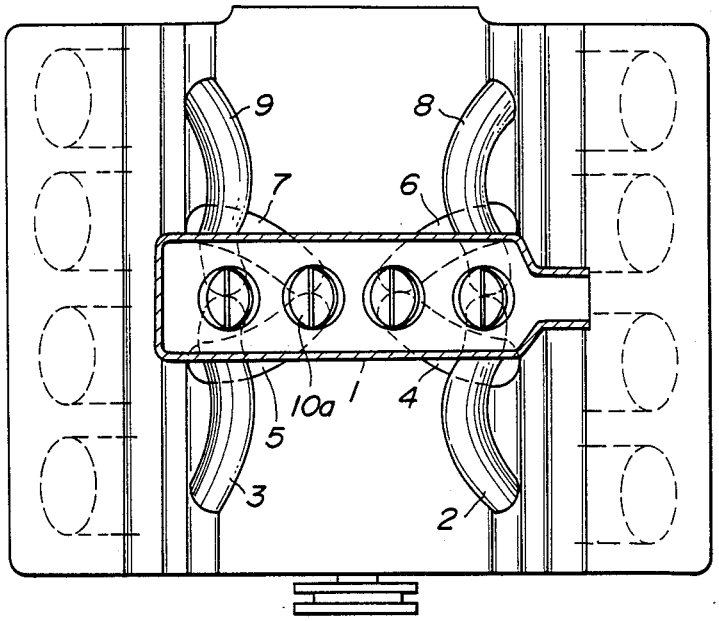
FIG.13 (PRIOR ART)
FIG. 13 is a top plan view of another prior art V-type multi-cylinder internal combustion engine.

Referring to FIGS. 1–3 in which parts and portions like or corresponding to those of the prior art arrangement shown in FIGS. 10–12 are designated by the same reference characters, a V-8 internal combustion engine has two rows of cylinders 16 (#1–#8), each row including four cylinders #1, #3, #5, #7 or #2, #4, #6, #8. The cylinders 16 in rows are arranged in a V-shape when viewed in an elevation of FIG. 3.

An elongated collector housing 1 is nearly rectangular in shape and disposed between the rows of cylinders #1–#8 so as to longitudinally extend across the rows at substantially the center thereof and at right angles. The surge tank 1 has at one longitudinal end an air inlet opening (not shown) through which it is communicated with a throttle chamber 10. Though not shown, the throttle chamber 10 has disposed therewithin a throttle valve for controlling flow of intake air therethrough.

The throttle chamber 10 is connected at the upstream end with an air duct 11 which is in turn connected at an upstream end with an air cleaner (not shown) so that clean air having passed the air cleaner is conducted to the collector housing 1 through the air duct 11, throttle chamber 10 and throttle valve.

The collector housing 1 has, at the opposite lateral ends spaced in the direction of the rows of cylinders #1–#8, eight openings **2*a*–9*a* in two rows extending in the direction transversal to the rows of cylinders #1–#8. The collector housing 1 is connected at the openings 2*a*–9*a* to intake pipes 2–9 which are communicated with the respective cylinders #1–#8 independently. In the meantime, the cylinders #1–#8 are divided into two groups by a vertical plane extending across the rows of cylinders #1–#8 at substantially the center thereof and at right angles. The first group of cylinders #5–#8 located at the upper half in FIG. 1 are communicated with the intake pipes 6–9 which are in turn communicated with the openings 6*a*–9*a*, respectively. The second group of cylinders #1–#4 located at the lower half in FIG. 1 are communicated with the intake pipes 2–5 7 which are in turn communicated with the openings 2*a*–5*a***, respectively.

In other words, the four cylinders #1, #2, #7 and #8 located at the opposite ends of the rows are communicated with the intake pipes 2, 3, 8 and 9 which are in turn communicated with the openings **2*a*, 3*a*, 8*a* and 9*a* located at the opposite ends of the rows. The four cylinders #3–#6 located at the inner parts of the rows are communicated with the intake pipes 4–7 which are in turn communicated with the openings 4*a*–7*a*** at the inner parts of the rows.

The intake pipes 2–9 include inlet portions 21-28 connected to the collector housing 1 in such a way as to communicate the openings **2*a*–9*a*, respectively. The inlet portions 21–28 may be formed together with the collector housing 1 so as to constitute a single piece, or may be secured thereto by welding or soldering. The intake pipe 2–9 further include bent or curved portions 29–36 integral with the inlet portions 21–28 and connecting pipe portions 37–44 independent from the inlet portions 21–28 and the curved portions 29–36. The connecting pipe portions 37–44 are connected at upstream ends to the curved portions 28–36 and at the downstream ends to the cylinder head 12 in such a way as to communicate intake ports 13 for each cylinders #1–#8**, respectively.

The inlet portions 21–28 re constructed and arranged so that the remoter they are located from the opposite ends of the collector housing 1 the longer they extend, i.e., the outer four are longer than the inner four. The curved portions 29–36 integral with the inlet portions 21–28 are constructed so as to curve about 90° and have at the downstream ends flanges the joining surfaces of which constitute part of a common plane nearly parallel to the upper and lower end surfaces of the collector housing 1.

The connecting pipe portions 37–44 have downstream end portions nearly coaxial with the intake ports 13 and extend curvedly from the downstream end portions toward the upstream ends and in such a way that some go toward the opposite row of cylinders #1–#8 and away from the collector housing 1 and some go away from the opposite row of cylinders #1–#8 and away from the collector housing 1 and in such a way as to have circumferential walls which extend across the axes of the intake ports 13.

More specifically, the connecting pipe portions 37, 38, 43 and 44 connected to the respective cylinders #1, #2, #7 and #8 at the opposite ends of the rows are constructed so as to have downstream end portions nearly coaxial with the intake ports 13 and extend curvedly from the downstream end portions toward the upstream ends and in such a way as to go away from the opposite row of cylinders #1–#8 and away from the collector housing 1, i.e., extend curvedly in such a way as to have at the places adjacent the intake ports 13 circumferential walls which extend across the axes of the intake ports 13.

The connecting pipes 39–42 connected to the cylinders #3–#6 located nearer the center of the rows are constructed so as to have downstream end portions nearly coaxial with the intake ports 13 and extend curvedly from the downstream end portions toward the upstream ends and in such a way as to go toward the respective opposite rows of cylinders #1–#8 and away from the collector housing 1.

By the above construction and arrangement, the connecting pipes 2–9 are provided with two groups of connecting pipe portions 37–44 which are arranged nearly straightly and nearly parallel to the respective rows of cylinders #1–#8.

The connecting pipe portions 37–44 are formed with hollow seat portions **2*b*–9*b* which are arranged in two straight lines parallel to the rows of cylinders #1–#8 and on which fuel injectors 20 are installed. Each row of the seat portions 2*b*, 4*b*, 6*b*, 8*b*, or 3*b*, 5*b*, 7*b*, 9*b* have mounting surfaces which constitute part of a common plane. The fuel injectors 20 are arranged so as to extend toward the intake ports 13 and intake valves 14, i.e., arranged so as to have injection orifices coaxial with the intake ports 13**.

The fuel injectors 20 are disposed at predetermined intervals along respective linear fuel supply conduits **20*a* for the respective rows of cylinders #1–#8** and connected thereto.

The connecting pipes 37–44 are extended curvedly in the above described manner toward the upstream ends and have at the upstream ends flanges the end faces of which constitute part of a common plane similarly to the mating downstream ends of the curved portions 29–36. The flanges at the upstream ends of the connecting pipe portions 37–44 are connected to the flanges at the downstream ends of the curved portions 29–36 with bolts and nuts so that the inlet portions 21–28, curved portions 29–36 and the connecting pipe portions 37–44 are communicated with each other to constitute the intake pipes 2–9. With the above arrangement, intake air is drawn from the collector housing 1 into the intake pipes 2–9 and supplied to each cylinders #1–#8 independently.

From the foregoing, it will be understood that the collector housing 1 is disposed substantially at the center of the rows of cylinders #1–#8 without allowing the space between the cylinders in rows to be exclusively occupied by the collector housing 1.

It will be further understood that the intake pipes 2–9 are extended from the opposite ends of the collector housing 1 spaced along the rows of cylinders #1–#8, i.e., spaced in the direction in which the cylinders #1–#8 are arranged in rows, thus making it possible to arrange the collector housing 1 at a relative low level.

It will be further understood that the inlet portions 21–28 are arranged so as to extend toward the rows of cylinders #1–#8 or in the direction transversal to the rows of cylinders #1–#8, i.e., arranged in the place where the engine accessories or the like that cause some obstructions are not provided, thus making it possible to attain a design freedom.

It will be further understood that the intake system of this invention makes it possible to attain the necessary lengths of the intake pipes 2–9, which are effective for attaining the inertia charge, through adjustment of the lengths of the inlet portions 21–28, thus making it possible to attain the desired volume of the collector housing 1 while reducing the curved portions of the intake pipes 2–9 to a minimum of necessity and therefore the flow resistance to a minimum value.

It will be further understood that the connecting pipe portions 37–44 extend curvedly toward and away from the rows of cylinders #1–#8, i.e., in the direction transversal to the rows of cylinders #1–#8 in such a way that the circumferential walls of the connecting pipes 37–44 adjacent the intake ports 13 extend across the axes of the intake ports 13.

It will be further understood that the intake pipes 2–9 are constructed so as to be vertically separable into two halves, i.e., each consist of two members which are detachably connected, thus making it easy to install the fuel injectors 20 on the connecting pipe portions 37–44 adjacent the intake ports 13 and curving across the axes of the intake ports 13.

It will be further understood that intake air flows faster at the radially outer part of the curved portions of the intake pipes 2–9 than the inner part of same and the seat portions **2*b*–9*b* are provided to the radially outer parts of the curved connecting pipe portions 37–44, thus making it possible to immediately supply the fuel injected by the fuel injectors 20 to the cylinders #1–#8**.

It will be further understood that the surge tank 1 is disposed at nearly the center of the rows of cylinders #1–#8 and the intake pipes 2–9 are arranged so as to extend from the collector housing 1 toward and away from the rows of cylinders #1–#8, thus making it easy to obtain spaces adjacent the opposite ends of the rows of cylinders #1–#8. For example, an alternator 46 may be arranged in such spaces for thereby reducing the overall length of the engine. In case of the prior art arrangement shown in FIG. 10, the elongated collector housing 1 is disposed in the space between the cylinders #1–#8 in rows in such a way that the longitudinal ends of the collector housing 1 are located adjacent the opposite ends of the rows of cylinders #1–#8. The distance l between the end of the alternator and the center of the nearest cylinder in this embodiment can be smaller than that in the prior art arrangement.

Referring to FIGS. 4 to 9 in which parts and portions like or corresponding to those of the previous embodiment of FIGS. 1–3 are designated by the same reference characters, another embodiment is substantially similar to the previous embodiment of FIGS. 1–3 except for a first fuel gallery 113 for supplying fuel to the fuel injectors 20 for the first group of cylinders #2, #4, #6 and #8 and a second fuel gallery 114 for supplying fuel to the fuel injectors 20 for the second group of cylinders #1, #3, #5 and #7.

Each of the fuel galleries 113 and 114 includes a plurality of pipe portions 118 communicated with a source of fuel under pressure as a fuel pump (not shown) and arranged in a straight line, a plurality of injector case portions 119 respectively interposed between adjacent two of the pipe portions 118 and rigidly secured to same and a plurality of brackets 115 rigidly secured to the respective pipe portions 118. The injector case portions 119 are communicated with the pipe portions 118 and adapted to be coupled with the respective fuel injectors 20 so as to introduce fuel from the source of fuel under pressure to the respective fuel injectors 20. The injector case portions 119 are rigidly secured to the pipe portions 118 so as to constitute a single unit together with the pipe portions 118 and the brackets 115. The fuel galleries 113 and 114 are installed on the connecting pipe portions 37–42 of intake pipes 2–9 by being connected thereto at the brackets 115.

Figure 9:
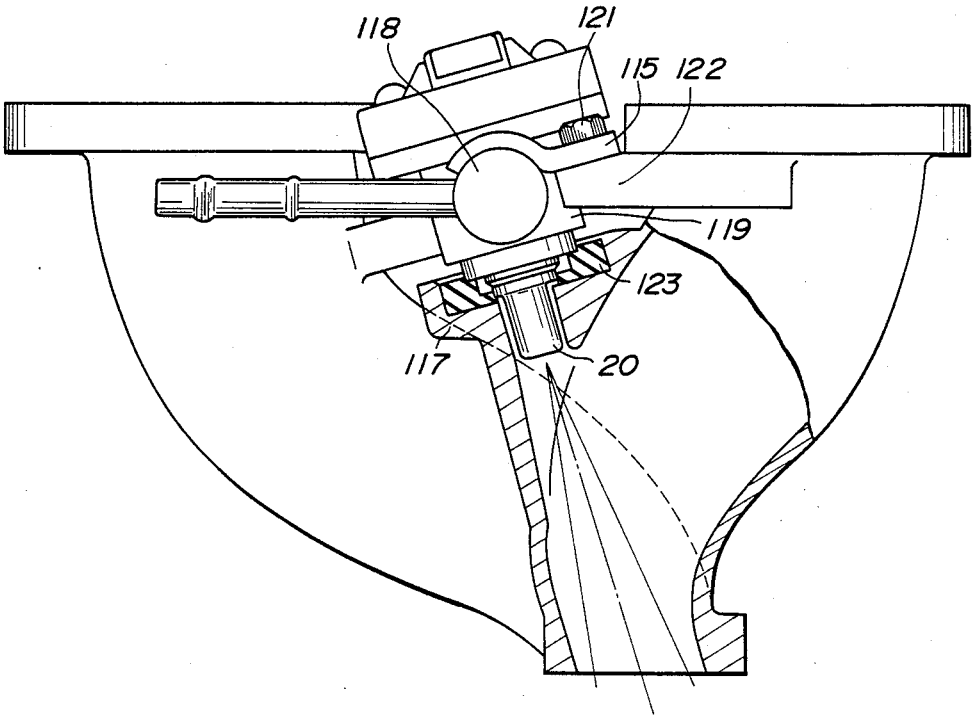
FIG. 9 is a view taken in the direction of the arrow "A" and partly sectioned.

More specifically, the brackets 115 of the first fuel gallery 113 are rigidly connected to the connecting pipes 38, 40, 42 and 44 to install the fuel injectors 20 on the seat portions **2*b*, 4*b*, 6*b* and 8*b*. The brackets 115 of the second fuel gallery 114 are rigidly connected to the inlet connecting pipe portions 37, 39, 41 and 43 to install the fuel injectors 20 on the seat portions 3*b*, 5*b*, 7*b* and 9*b*. The fuel injectors 20 are softly installed on the seat portions 2*b*–9*b* by interposing therebetween rubber seals 123 for providing a seal and a heat insulation therebetween as shown in FIG. 9. In this connection, the fuel injectors 20 are installed at the same angle 8 relative to the downstream end faces of the connecting pipe portions 37–42, i.e., installed at the same angle relative to the cylinder head 15**.

The connecting pipe portions 37–42 have integral bracket mounts 122 to which the brackets 115 are secured with bolts 121.

Figure 5:
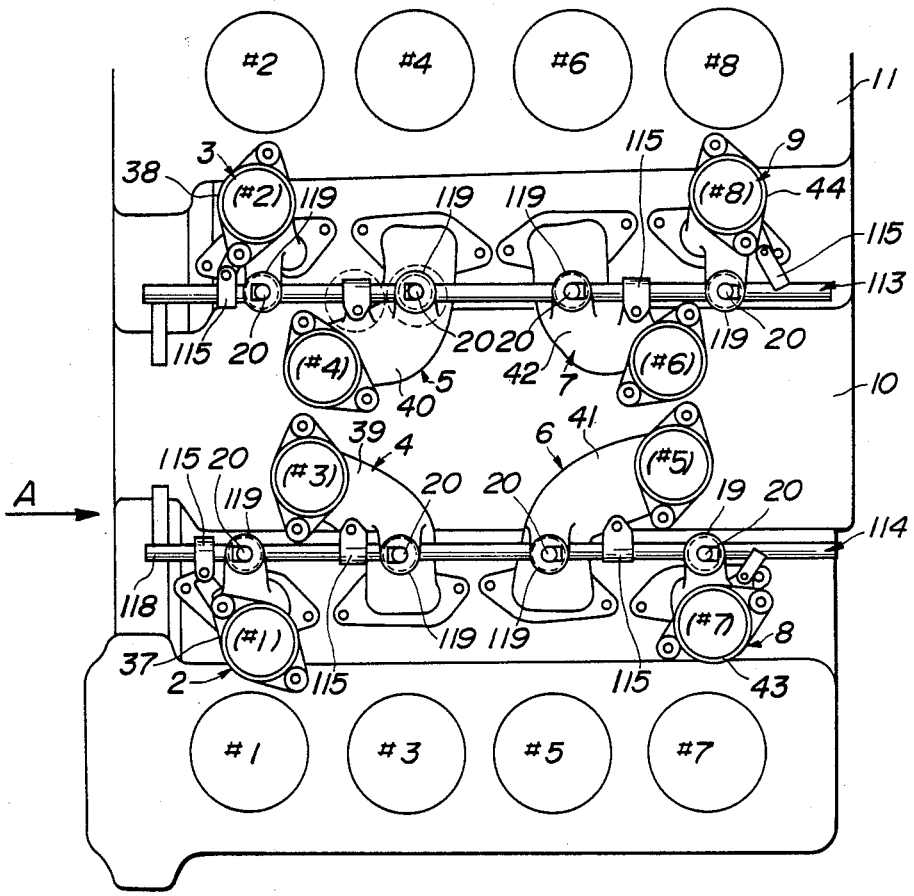
FIG. 5 is a top plan view of the intake system of another embodiment, with the collector housing and the portions of the intake pipes of FIG. 4 being omitted.
Figure 6:
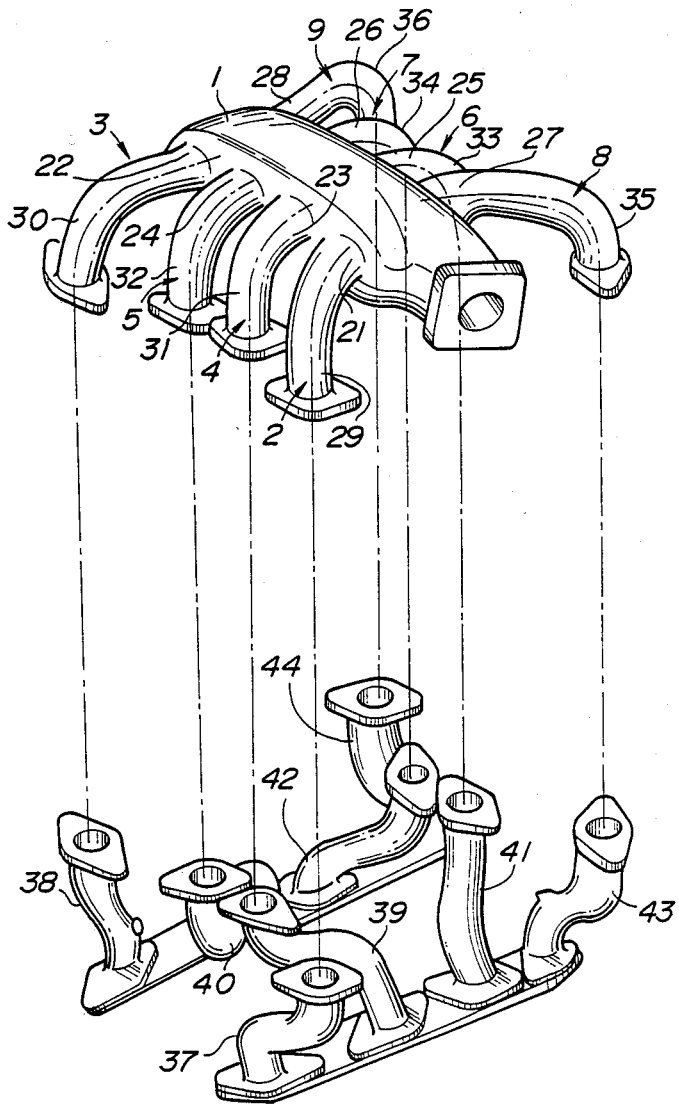
FIG. 6 is a foreshortened exploded perspective view of the collector housing and intake pipes of the intake system of FIGS. 4 and 5.
Figure 7:
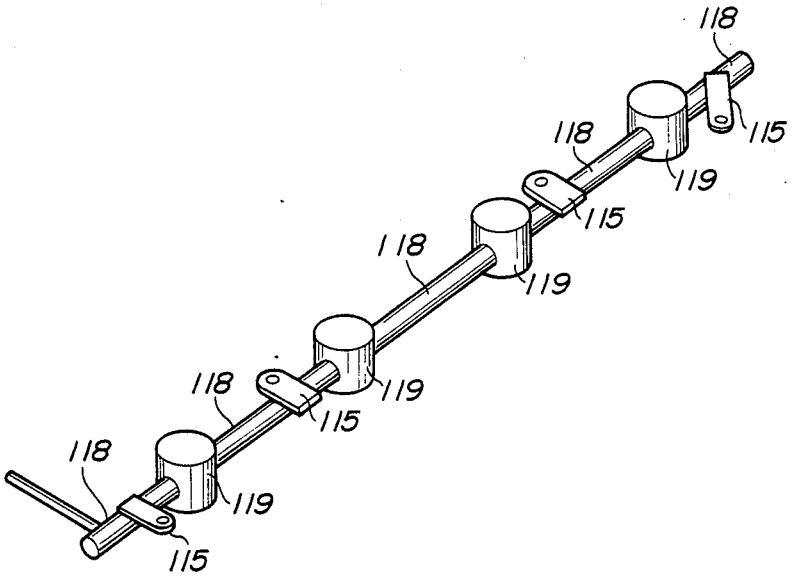
FIG. 7 is an enlarged perspective view of a fuel gallery employed in the intake system of FIGS. 4 to 6.
Figure 8:
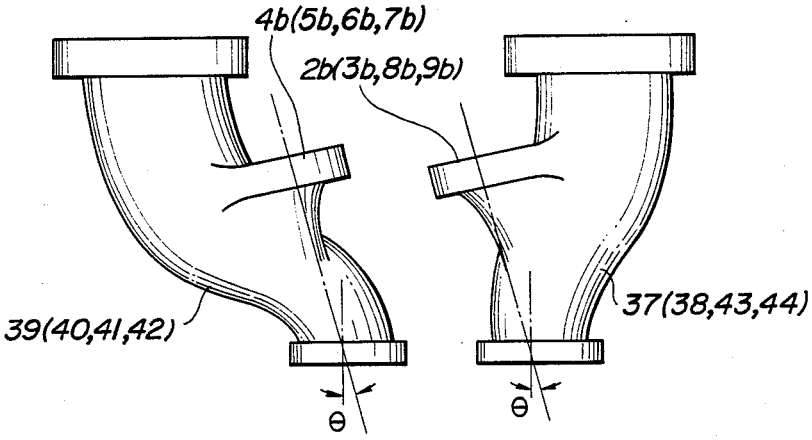
FIG. 8 is a side elevational view of connecting pipe portions of the intake pipes employed in the intake system of FIGS. 4 to 7.

As best seen in FIG. 5, each of the fuel galleries 113 and 114 and the corresponding group of connecting pipe portions 37–42 are so constructed and arranged that the straight pipe portion 118 extend through the corresponding groups of the connecting pipe portions 37–42 on the alternately different sides thereof, i.e., extend through one connecting pipe portion on one side thereof and then the next connecting pipe portion on the opposite side thereof. For example, the pipe portion 118 extends through the connecting pipe portions 38, 40, 42, 44 on one side of the connecting pipe portions 38, 44 and on the other side of the connecting pipe portions 40 and 42 That is, the seat portions 2b and 8b are located on one side of the connecting pipe portions 38 and 44, and the seat portions **4*b* and 6*b* are on the other side of the connecting pipe portions 40 and 42. In other words, the fuel pipes 2 and 8 are located on one side of the fuel pipe 118, and the fuel pipes 4 and 6 are located on the other side of the fuel pipe 118**.

With the foregoing arrangement, the fuel galleries 113 and 114 can be handled as a single unit together with the connecting pipe portions 37–42 of the intake pipes 2–9 after installation thereon since the former is rigidly connected to the latter. Installation of the fuel galleries 113 and 114 to the connecting pipe portions 37–42 of the intake pipes 2–9 are performed accurately by using a jig.

It will be further understood that the fuel injectors 20 are installed at the same angle relative to the cylinder head 15, whereby to prevent variations of the position toward which fuel is injected, from cylinder to cylinder.

Figure 14:
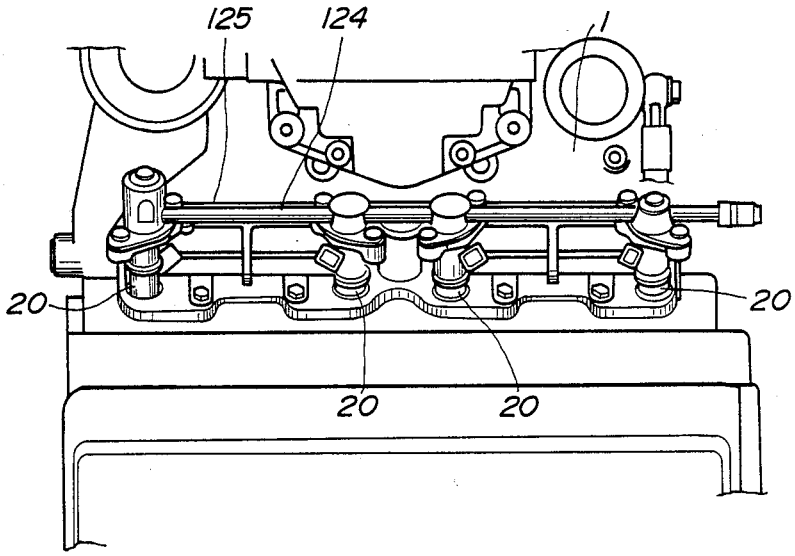
FIG.14 (PRIOR ART)
FIG. 14 is a perspective view of a prior art intake system.
Figure 15:
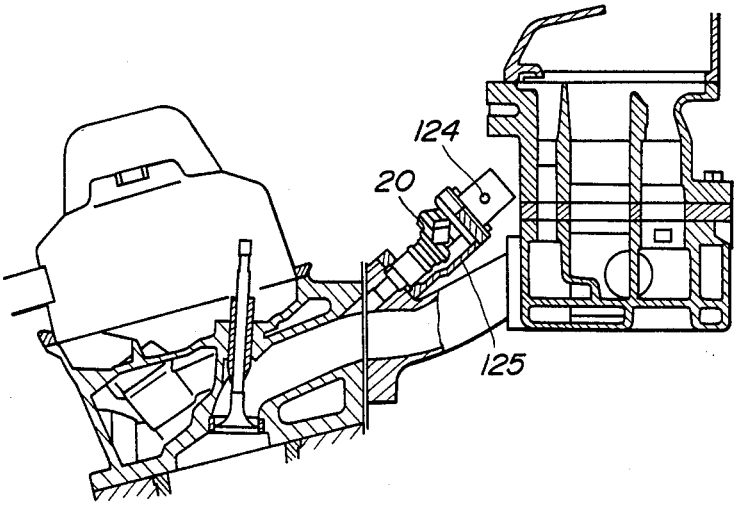
FIG.15 (PRIOR ART)
FIG. 15 is a sectional view of the prior art intake system of FIG. 14.
Figure 16:
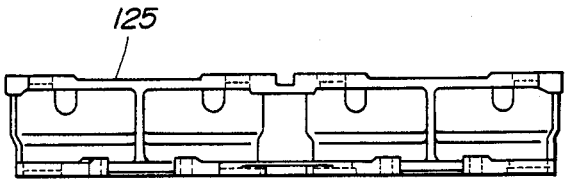
FIG.16 (PRIOR ART)
FIG. 16 is a holder employed in the prior art intake system of FIG. 14.

It will be further understood that the intake system of this invention does not require such a holder for installation of fuel galleries and fuel injectors as in prior art arrangement. In this connection, FIGS. 14–16 shows a prior art intake system in which a holder 125 is utilized for installation of injectors 20 and a fuel pipe 124. The holder 125 is bulky and heavy. Therefore, the prior art intake system is disadvantageous not only from the point of view of the number of constituent parts and the weight but from the point of view of the manufacturing and assembling expense. The intake system of this embodiment can dispense with such a holder 125 and therefore is effective for reducing the number of constituent parts, the weight and the manufacturing and assembling expense.

While the present invention has been described and shown as being applied to a V-8 internal combustion engine, this is not limitative but the present invention can be applied similarly to a V-6 or V-12 internal combustion engine.

What is claimed is:

1. An intake system for a V-type multi-cylinder internal combustion engine, comprising:

an elongated collector housing disposed between two rows of cylinders in such a way as to longitudinally extend across said rows at substantially the center thereof;

a plurality of intake pipes of substantially the same length, extending independently from said collector housing and communicated with intake ports for said cylinders, respectively;

said collector housing having at the opposite ends spaced along said rows of said cylinders, a plurality of openings in two rows extending in the direction transverse to said rows of said cylinders;

said intake pipes being connected to said collector housing in such a way as to communicate with said openings, respectively;

said intake pipes extending curvedly away from said openings and in such a way as to go toward said rows of cylinders and away from said collector housing; and said intake pipes further extending curvedly toward said intake ports and in such a way as to have adjacent said intake ports, circumferential walls which extend across the axes of said intake ports and thereafter extend nearly coaxially with said intake ports.

2. An intake system for a V-type multi-cylinder internal combustion engine, comprising:

an elongated collector housing disposed between two rows of cylinders in such a way as to longitudinally extend across said rows at substantially the center thereof;

said collector housing having at the opposite lateral ends spaced along said rows of cylinders, a plurality of openings in two rows extending in the direction transverse to said rows of said cylinders;

a cylinder head having a plurality of intake ports for said cylinders; and a plurality of intake pipes of substantially the same length, extending independently from said collector housing and communicated with said intake ports, respectively;

said intake pipes having inlet portions integrally connected to said collector housing in such a way as to communicate with said openings, respectively, curved portions integral with said inlet portions and connecting pipe portions independent from said curved portions and said inlet portions;

said connecting pipe portions having downstream end portions nearly coaxial with said intake ports and extending curvedly from said downstream end portions toward upstream ends and in such a way that some go toward the opposite row of said cylinders and away from said collector housing and some go away from the opposite row of cylinders and away from said collector housing and in such a way as to have circumferential walls extending across the axes of said intake ports;

said curved portions being curved to have downstream ends which are located in a common plane and detachably connected at said downstream ends to said upstream ends of said connecting pipe.

3. The intake system according to claim 2 wherein said first mentioned some of said connecting portions are connected to some of said cylinders which are located nearer to the center of said rows than some of said cylinders to which said second mentioned some of said connecting portions are connected.

4. The intake system according to claim 3 wherein said curved portions have at the downstream ends thereof flanges having joining surfaces which constitute part of said common plane, and said connecting pipe portions having at the upstream ends thereof flanges having joining surfaces which constitute part of said common plane, said flanges of said curved portions and said flange of said connecting pipe portions being bolted together.

5. The intake system according to claim 4 wherein said connecting pipe portions of said intake pipes have adjacent said intake ports, seat portions for installation of fuel injectors, said seat portions being arranged in two straight lines parallel to said rows of said cylinders.

6. The intake system according to claim 5 wherein said seat portions have mounting surfaces which constitute part of a common plane.

7. The intake system according to claim 6 wherein said seat portions in each of said lines are provided on the different sides of said connecting pipe portions.

8. The intake system according to claim 7, further comprising two fuel galleries for supply of fuel to said fuel injectors, each of said fuel galleries comprising a plurality of pipe portions arranged in a straight line, a plurality of injector case portions interposed between adjacent two of said fuel pipe portions, and a plurality of brackets secured to said pipe portions respectively, said injector case portions being rigidly connected to said pipe portions so as to constitute a single unit together with said pipe portions and said brackets, said fuel galleries and said fuel injectors being installed by connecting said brackets to said connecting pipe portions of said intake pipes.

9. The intake system according to claim 8 wherein said curved pipe portions have bracket mounts to which said brackets are bolted.

10. The intake system according to claim 9 wherein said injectors are installed on said seat portions of said connecting pipe portions at the same angle relative to said cylinder head.

11. The intake system according to claim 10 wherein said fuel galleries are installed on said connecting pipe portions so as to constitute therewith two integral units.

* * * * *